US008751071B2

(12) United States Patent
Woo et al.

(10) Patent No.: US 8,751,071 B2
(45) Date of Patent: Jun. 10, 2014

(54) SYSTEM AND METHOD FOR CONTROLLING A VEHICLE

(75) Inventors: Derek Kevin Woo, Rockledge, FL (US); Robert C. Palanti, Melbourne, FL (US); Carlos Cesar Sabino Paulino, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 72 days.

(21) Appl. No.: 13/461,364

(22) Filed: May 1, 2012

(65) Prior Publication Data

US 2012/0290156 A1 Nov. 15, 2012

Related U.S. Application Data

(60) Provisional application No. 61/484,153, filed on May 9, 2011.

(51) Int. Cl.
*G05D 1/00* (2006.01)

(52) U.S. Cl.
USPC ..... 701/19; 701/36

(58) Field of Classification Search
USPC ..... 701/19, 36, 70; 105/61
See application file for complete search history.

(56) References Cited

U.S. PATENT DOCUMENTS

| | | | | |
|---|---|---|---|---|
| 4,041,470 | A | 8/1977 | Slane et al. | |
| 4,344,364 | A * | 8/1982 | Nickles et al. | 105/62.1 |
| 4,718,622 | A * | 1/1988 | Rahman | 246/169 R |
| 4,774,669 | A | 9/1988 | Schmitz et al. | |
| 5,053,964 | A * | 10/1991 | Mister et al. | 701/19 |
| 5,563,785 | A * | 10/1996 | Wolf et al. | 701/29.2 |
| 5,890,080 | A | 3/1999 | Coverdill et al. | |
| 6,095,618 | A | 8/2000 | Heneka et al. | |
| 6,128,555 | A | 10/2000 | Hanson et al. | |
| 6,135,396 | A | 10/2000 | Whitfield et al. | |
| 6,144,901 | A * | 11/2000 | Nickles et al. | 701/19 |
| 6,401,015 | B1 * | 6/2002 | Stewart et al. | 701/19 |
| 6,542,076 | B1 | 4/2003 | Joao | |
| 6,763,291 | B1 * | 7/2004 | Houpt et al. | 701/19 |
| 6,876,907 | B2 | 4/2005 | Kanner et al. | |
| 6,886,472 | B2 | 5/2005 | Jammu et al. | |
| 7,139,646 | B2 * | 11/2006 | Kane et al. | 701/19 |
| 8,589,003 | B2 * | 11/2013 | Brand et al. | 701/20 |
| 8,645,010 | B2 * | 2/2014 | Cooper et al. | 701/19 |
| 2002/0059075 | A1 | 5/2002 | Schick et al. | |
| 2003/0055666 | A1 | 3/2003 | Roddy et al. | |
| 2003/0094546 | A1 * | 5/2003 | Kellner et al. | 246/167 R |

(Continued)

OTHER PUBLICATIONS

Search Report and Written Opinion from corresponding PCT Application No. PCT/US2012/036512 dated Jan. 18, 2013.

*Primary Examiner* — Helal A Algahaim
*Assistant Examiner* — Shardul Patel
(74) *Attorney, Agent, or Firm* — GE Global Patent Operation; John A. Kramer

(57) ABSTRACT

A method of controlling a vehicle system includes receiving information of a failure condition in a first rail vehicle of a rail vehicle consist. The method further includes, in response to the failure condition, controlling a second rail vehicle of the rail vehicle consist from a first operational mode to a different, second operational mode. In the second operational mode, the second rail vehicle performs a function that the first rail vehicle cannot due to the failure condition. The information is received over a distributed power system of the rail vehicle consist, and/or the second rail vehicle is controlled over the distributed power system.

16 Claims, 3 Drawing Sheets

(56) References Cited

U.S. PATENT DOCUMENTS

2003/0213875 A1* 11/2003 Hess et al. ..... 246/167 R
2006/0025903 A1* 2/2006 Kumar ..... 701/19
2008/0027591 A1 1/2008 Lenser et al.
2010/0235017 A1 9/2010 Peltonin et al.
2011/0309206 A1* 12/2011 Smith ..... 246/169 R
2012/0318931 A1* 12/2012 Cooper et al. ..... 246/167 R

* cited by examiner

SYSTEM AND METHOD FOR CONTROLLING A VEHICLE

CROSS-REFERENCE TO RELATED APPLICATIONS

This application claims the benefit of U.S. Provisional Application Ser. No. 61/484,153, filed on May 9, 2011, which is herein incorporated by reference in its entirety.

FIELD OF THE INVENTION

Embodiments of the invention relate to vehicle control. Other embodiments relate to controlling vehicles in a vehicle consist.

BACKGROUND OF THE INVENTION

A vehicle "consist" is group of two or more vehicles mechanically coupled or linked together to travel along a route. For example, a rail vehicle consist is a group of two or more rail vehicles that are mechanically coupled or linked together to travel along a route, as defined by a set of rails that support and guide the rail vehicle consist. One type of rail vehicle consist is a train, which may include one or more locomotives (or other powered rail cars/vehicles) and one or more non-powered rail cars/vehicles. (In the context of a rail vehicle consist, "powered" means capable of self propulsion and "non-powered" means incapable of self propulsion.) Each locomotive includes traction equipment for moving the train, whereas each rail car is configured for hauling passengers or freight. For producing motive effort, most modern locomotives use electric motors. In a typical case, a locomotive will include plural motors. For each motor, a pinion gear is attached to the output shaft of the motor, for driving a bull gear operably attached to a traction wheel set of the locomotive. For operation of the motor, the motor is supplied with electricity. In some locomotives, the locomotive may include an on-board power source for providing traction electricity (meaning electricity of suitable magnitude to power traction motors for moving a train). In other locomotives, traction electricity is received from an off-board source, such as a third rail or an overhead catenary line.

Rail vehicles typically include an airbrake system. The airbrake system includes a source of pressurized air, and, on each rail vehicle, a brake pipe, a brake mechanism, and one or more valves or other control elements for controlling braking. When rail vehicles are assembled in a consist, the brake pipe interconnects the vehicles of the consist. The brake mechanism on each vehicle is reverse pressure dependent, meaning the mechanism is deactivated (no braking) when pressure is present, and activated when pressure is not present. This facilitates automatic emergency braking if air pressure is lost.

During operation of a rail vehicle consist, if a component of the airbrake system fails, the consist may be brought into an emergency or other contingent operational mode. For example, information of a failure may be detected remotely and communicated to a lead locomotive or other rail vehicle, with the operator bringing the consist to a stop. Alternatively, in some systems and depending on the failure in question, the consist may be automatically controlled to a stop. In either case, the crew must walk back along the train in an attempt to correct the failure, and/or call in additional locomotive assets, such as a helper locomotive to assist in charging the brake pipe or removing vehicles/cars from the consist. Thus, not only is the consist itself delayed, but the track on which it is traveling is blocked. Additionally, depending on weather conditions and the current location of the consist, it may be dangerous for the crew to walk back to a remote part of the consist for attempting to correct the failure.

BRIEF DESCRIPTION OF THE INVENTION

In one embodiment, a method of controlling a vehicle system comprises receiving information of a failure condition (e.g., of a brake system component) in a first rail vehicle of a rail vehicle consist. The method further comprises, in response to the failure condition, controlling a second rail vehicle of the rail vehicle consist from a first operational mode to a different, second operational mode. In the second operational mode, the second rail vehicle performs a function that the first rail vehicle cannot due to the failure condition. (The function may be absolute, meaning the first rail vehicle cannot perform the function at all, or it may be a matter of degree, meaning the first rail vehicle cannot perform the function at or above a designated minimum performance level.) The information is received over a distributed power system of the rail vehicle consist, and/or the second rail vehicle is controlled over the distributed power system.

In this manner, according to an aspect of the invention, the second rail vehicle is controlled to "take over" the role of the first rail vehicle, as relating at least to the failure condition, using the distributed power system of the rail vehicle consist. This may allow the consist to function at least nominally, for self-propulsion of the consist to an area for inspection, without requiring long delays or the crew to walk the consist.

In another embodiment, a method of controlling a vehicle system includes, at a third rail vehicle of a rail vehicle consist, receiving information of a failure condition in a first rail vehicle of the rail vehicle consist, wherein the information is received over a communication channel of a distributed power system of the rail vehicle consist, and, in response to the failure condition, controlling a second rail vehicle of the rail vehicle consist from a first operational mode to a different, second operational mode, wherein in the second operational mode, the second rail vehicle performs a function that the first rail vehicle cannot due to the failure condition. The second rail vehicle may be controlled over the distributed power system.

According to another embodiment, a system includes a control module configured for deployment on a rail vehicle of a rail vehicle consist, the control module being configured to receive information about a failure condition of a component of a system deployed on the rail vehicle or other rail vehicles of the consist and to generate control signals for controlling the rail vehicle or the other rail vehicles in response to the failure condition. The control module may further be configured for interfacing with a distributed power system of the rail vehicle consist.

BRIEF DESCRIPTION OF THE DRAWINGS

The present invention will be better understood from reading the following description of non-limiting embodiments, with reference to the attached drawings.

DETAILED DESCRIPTION OF THE INVENTION

Embodiments of the invention relate to systems and methods for controlling a vehicle, e.g., a rail vehicle in a train or other rail vehicle consist. According to one aspect, operation of the rail vehicle consist is monitored, and if a failure condition occurs in one of the rail vehicles of the consist, a distributed power system of the consist is used to control another rail vehicle of the consist for (in effect) "taking over" for the failed rail vehicle. For example, if a brake system component fails in a first rail vehicle, a second, adjacent rail vehicle may be controlled, over the distributed power system, from a distributed power trail remote mode to a distributed power lead remote mode. Correspondingly, the first rail vehicle may be controlled from lead mode to trail mode. Once in the lead remote mode, the airbrake system of the second rail vehicle is able to control airbrake pressure, with the airbrake system of the first rail vehicle (now in trail mode) being controlled passively and not inhibiting overall consist operation despite the brake system component failure. Depending on location and other constraints, the rail vehicle consist may then be motored as normal, or motored for moving the consist to a designated location for inspection and repair.

Figure 1:
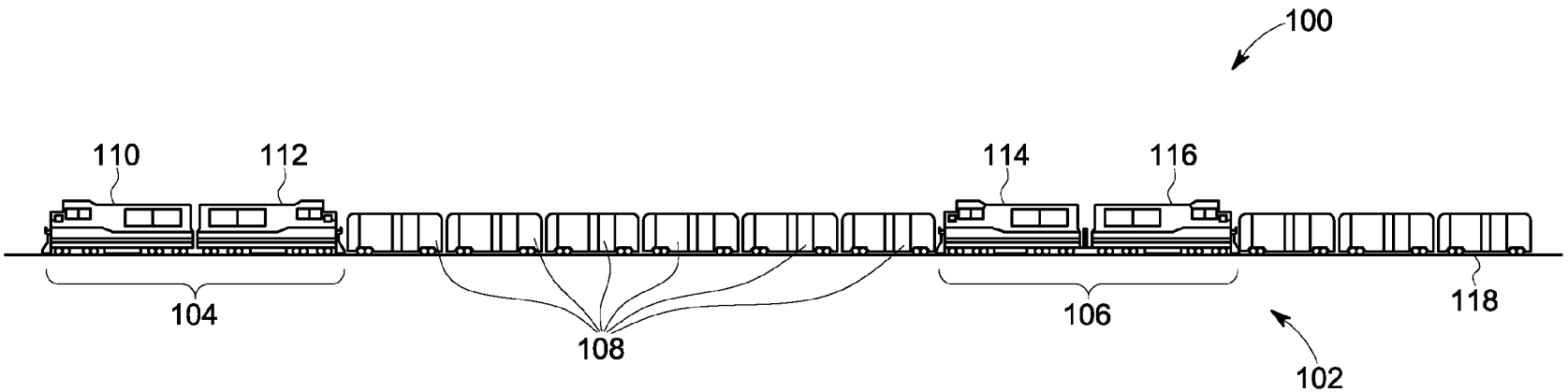
FIG. 1 is a schematic view of a system for controlling a vehicle, according to an embodiment of the invention.
Figure 2:
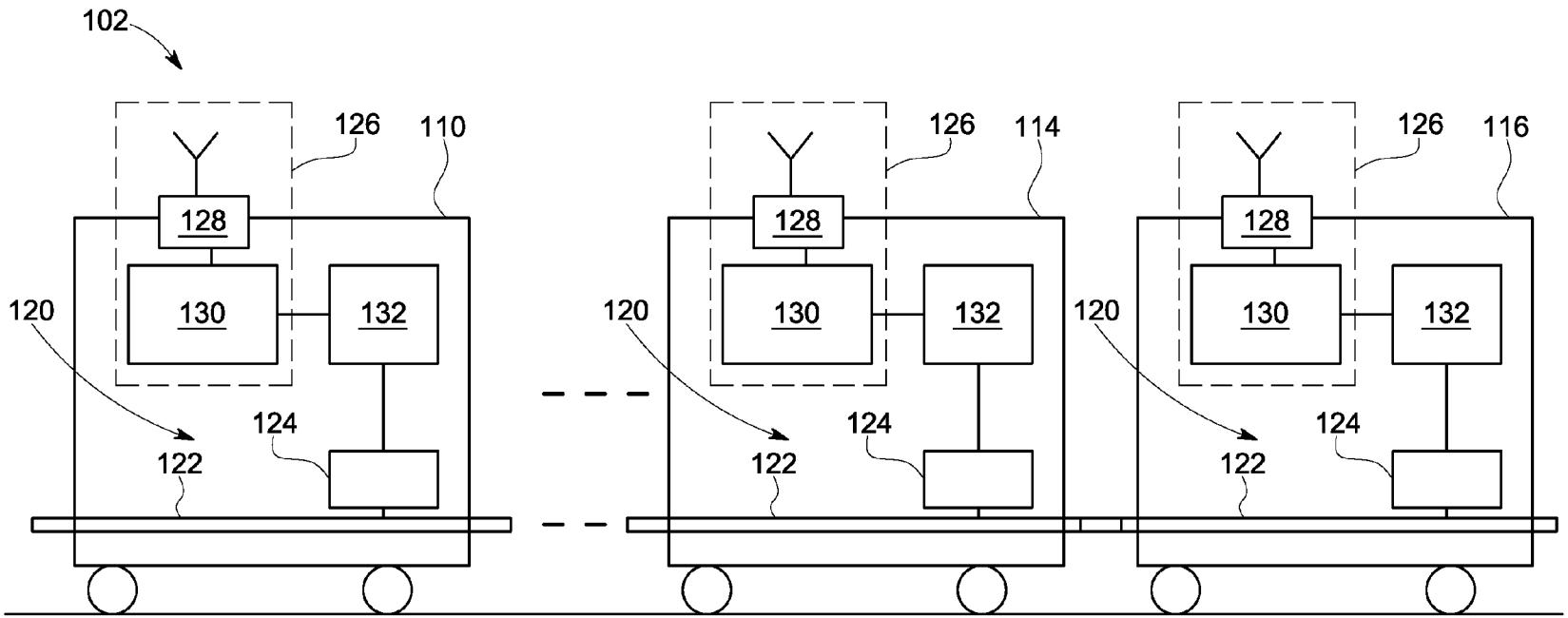
FIG. 2 is a schematic view of a system for controlling a vehicle, according to another embodiment.

FIGS. 1 and 2 illustrate embodiments of a system 100 and method for controlling a vehicle, e.g., a rail vehicle in a train or other rail vehicle consist 102. The vehicle consist 102 includes various powered rail vehicles and non-powered rail vehicles. The powered rail vehicles may be locomotives, and for illustration purposes, the powered rail vehicles will be referred to as such in the following description. It should be noted, however, that where a locomotive is referred to, the description is applicable to powered rail vehicles more generally.

The rail vehicle consist 102 includes a lead locomotive consist 104, a remote locomotive consist 106, and plural non-powered rail vehicles (e.g., freight cars) 108 positioned between the two consists 104, 106. The lead locomotive consist 104 includes a lead locomotive 110 and a trail locomotive 112 adjacent to the lead locomotive. The remote locomotive consist 106 includes a lead remote locomotive 114 and a trail remote locomotive 116, which is adjacent to the lead remote locomotive 114. All the vehicles of the consist 102 are sequentially mechanically connected together for traveling along a rail track or other guideway 118. As illustrated schematically in FIG. 2, the rail vehicle consist 102 has an airbrake system 120. The airbrake system 120 includes a source of pressurized air, and on each locomotive and other vehicle, a brake pipe 122, a brake mechanism, and one or more valves or other control elements for controlling braking. The brake mechanisms and control elements are shown schematically grouped together at 124. The source of pressured air may be a respective air compressor system on each locomotive. (That is, in a typical rail vehicle consist, the locomotives or other powered rail vehicles provide pressurized air and associated control for charging the brake pipe of the rail vehicle consist.) Each vehicle of the consist 102 includes fore and aft flexible pressure couplings (or similar mechanisms) for sequentially fluidly coupling individual sections of the brake pipe together when the vehicles are assembled in the consist; thus, in the consist 102, the brake pipe 122 is a fluidly unitary conduit that extends along the length of the consist 102.

Further in the rail vehicle consist 102, at least some of the locomotives 110, 114, 116 are each equipped with a distributed power system 126. "Distributed power" refers to a system for coordinated traction control (e.g., motoring and braking) of remote locomotives in a consist. In a distributed power system, remote locomotives are in communication with a designated lead locomotive. On each remote locomotive, the distributed power system is configured to automatically control the remote locomotive based on distributed power control signals received from the lead locomotive. For example, the system may be configured such that if the lead locomotive is controlled to a particular notch or other throttle setting, the remote locomotives are automatically controlled to a similar notch or other throttle setting. This enables the remote locomotives to be spaced apart from the lead locomotive in the rail vehicle consist, which is beneficial for long freight trains or the like. For communications between the lead and remote locomotives, the distributed power system may use one or more wireless communication channels, or a wired communication channel. Additionally, the distributed power system may have one or more designated modes of operation, such as lead mode, trail mode, lead remote mode, and trail remote mode. Lead mode is a mode of operation for a designated lead locomotive (i.e., a "master" locomotive), wherein other locomotives in the train or other consist are automatically controlled based on how the lead locomotive is controlled. "Lead" refers not necessarily to the lead locomotive being first in a train or other consist, but rather that the lead locomotive is the designated master controller for distributed power operations. The trail mode is where a locomotive is automatically controlled based on a lead locomotive. Lead remote mode is a mode where a remote locomotive is automatically controlled based on a lead locomotive, but also functions to control trail locomotives that are directly connected to it in a remote locomotive consist. Trail remote mode is a mode where a locomotive in a remote locomotive consist is automatically controlled based on a designated lead remote locomotive in the remote locomotive consist. Thus, for distributed power operations in a rail vehicle consist 102 such as shown in FIG. 1, the locomotive 110 may be a designated lead locomotive operating in lead mode, the locomotive 112 may be a designated trail locomotive operating in trail mode, the locomotive 114 (part of remote locomotive consist 106) may be a designated lead remote locomotive operating in lead remote mode, and the locomotive 116 may be a designated trail remote locomotive operating in trail remote mode.

Distributed power systems are existing equipment on many locomotives, and/or may be available from suppliers such as General Electric Company, under brand name Locotrol® system. As shown in FIG. 2, the distributed power system 126 may include, on each locomotive so-equipped, a distributed power transceiver 128 (wired or, as shown, wireless) and a distributed power controller 130 operably connected to the transceiver 128 and to a locomotive control unit 132 of the locomotive.

In an embodiment of the system 100 and method, as noted above, ongoing operation of the rail vehicle consist 102 is monitored, and if a failure condition occurs in one of the rail vehicles of the consist, the distributed power system 126 of the consist 102 is used to control another rail vehicle of the consist for operating in place of the failed rail vehicle. Ongoing operation may be monitored using various sensors operably coupled with various sub-systems of the consist 102, as an existing function of the consist, and/or as a function of the distributed power system, and/or otherwise. For example, in a distributed power-equipped train or other rail vehicle consist, sensor data of various sub-systems on each locomotive may be transmitted to a designated lead locomotive, and/or data may be transmitted when there is a fault or other failure. In one instance, the airbrake system 120 on each locomotive includes plural sensors for monitoring operations of the airbrake system. If a component of the airbrake system fails, such as in a remote locomotive 114, 116, information about the failure is generated by the sensor(s), communicated to the distributed power system 126 of the remote locomotive, and communicated (e.g., wirelessly) to the lead locomotive (e.g., locomotive 110). The information may be displayed to an operator for alerting the operator about the failure, or the information may be used as a basis for automatically controlling the rail vehicle consist 102, such as bringing the consist 102 to a stop.

As used herein, "failure condition" means a condition of a powered rail vehicle where the powered rail vehicle, or component thereof, cannot perform a designated function that it would normally be able to perform. As noted above, the function may be absolute, meaning the first rail vehicle cannot perform the function at all, or it may be a matter of degree, meaning the first rail vehicle cannot perform the function at or above a designated minimum performance level. Thus, "failure" includes not only complete component malfunctions (unable to work at all), but also situations where the component functions but less than optimally, and also situations where a fault (possible component malfunction) is registered, due to sensor data, but the component may still be able to operate at reduced or even normal capacity (i.e., where it is uncertain if the component is normally operable).

Figure 3:
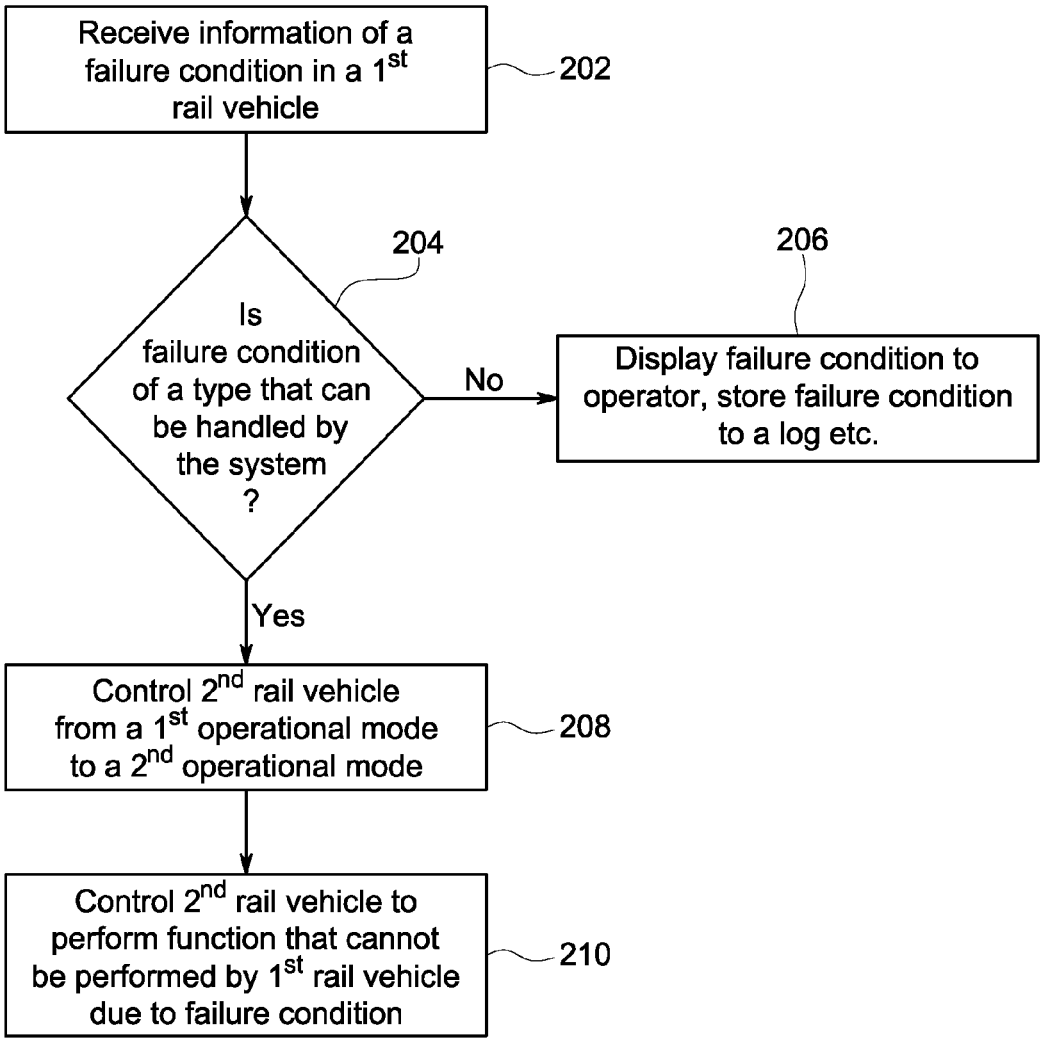
FIG. 3 is a flowchart illustrating a simplified control subroutine of a method of controlling a vehicle system, according to an embodiment of the invention.

If a failure condition occurs in one of the rail vehicles of the consist 102, e.g., first remote locomotive 114, the distributed power system 126 of the consist 102 is used to control another rail vehicle of the consist, e.g., second remote locomotive 116, for operating in place of the "failed" locomotive 114. ("Failed" rail vehicle means a rail vehicle where a failure condition has occurred, not necessarily that the entire vehicle is nonfunctional.) More specifically, with reference to FIG. 3, information of the failure condition is transmitted over the distributed power system 126 from the failed locomotive 114 to a designated distributed power lead locomotive 110 of the consist 102, as shown at step 202. At the lead locomotive 110, and based on the received information of the failure condition, it is determined whether the failure condition is of a type that can be handled by the system 100, as shown at step 204. (For this purpose, or for the other functions described herein, the distributed power system and/or the locomotive control unit 132 may be outfitted with hardware and/or software modules configured to control the locomotive to carry out the indicated functions, as part of the system 100.) If not, as shown at step 206, the failure condition may be displayed to an operator, and/or the information of the failure condition may be stored to a log, and/or the consist 102 may be controlled, automatically or otherwise, based on the information, in a designated manner not part of the system 100. If the failure condition is of a type that can be handled by the system 100, the system 100 controls the distributed power system 126 of the consist 102, to cause another rail vehicle of the consist, e.g., the remote locomotive 116, to operate in place of the failed locomotive 114, as discussed hereinafter. This may be done automatically, or only subsequent display to an operator and approval by the operator.

In connection with the above, in an embodiment, for controlling a locomotive 116 to operate in place of a failed locomotive 114, the system 100 (and method) is configured to control the second locomotive 116 from a first operational mode to a different, second operational mode, as shown at step 208. As shown at step 210, in the second operational mode, the second locomotive 116 performs the function that the first, failed locomotive 114 cannot due to the failure condition. For example, one or more distributed power command signals may be transmitted from the lead locomotive 110 to the second locomotive 116, over the wireless or other distributed power communication channel. The distributed power command signals are configured, e.g., in a standard format according to the distributed power system in question, to be "understood" and automatically executed by the second locomotive 116. For example, the first operational mode may be trail remote mode, and the second operational mode may be lead remote mode, with the distributed power command signals being configured such that the distributed power system of the second locomotive, upon receiving the command signals, automatically transitions the second locomotive from the trail remote mode to the lead remote mode of operation.

Concurrently or subsequently, depending on the operational modes in question, the failed locomotive 114 may be controlled from one operational mode to another, e.g., from a "third" operational mode to a "fourth" operational mode. In an embodiment, the system 100 is configured in this regard. (Third and fourth don't necessarily imply completely different types of operational modes from what the second locomotive 116 is controlled to, but rather serve as designators that the modes are associated with the failed locomotive.) For example, in the case of a remote locomotive consist 106 where the first locomotive 114 is a designated lead remote and the second, adjacent locomotive 116 is a designated trail remote, if there is a failure condition in the first locomotive 114, and the system 100 controls the second locomotive 116 through the distributed power system from trail remote mode to lead remote mode, then the failed, first locomotive 114 is controlled from lead remote mode to trail remote mode. Again, according to an aspect of the invention, this is done by the lead locomotive (under control of the system 100) transmitting distributed power command signals to the remote consist 106 over the distributed power communication channel.

Subsequent to the second locomotive 116 being controlled from the first operational mode to the different, second operational mode (and possibly the first, failed locomotive being similarly controlled), the second locomotive operates in place of the first locomotive, at least in regards to performing the function that the first locomotive cannot due to the failure condition. The rail vehicle consist 102 may then be motored as normal, or motored for moving the consist to a designated location for inspection and repair, or otherwise controlled depending on the failure in question, the current location of the consist 102, weather and other variable conditions, etc.

Embodiments of the system 100 may be especially useful for handling airbrake component failures in a distributed power-equipped consist 102. In an embodiment, the system 100 is configured such that if a component of a brake system 120 fails in a first locomotive 114 (operating as a distributed power lead remote), a second, adjacent locomotive 116 (operating as a distributed power trail remote) is controlled, over the distributed power system 126, to transition from the trail remote mode to the lead remote mode. Correspondingly, the first locomotive 114 is controlled from lead remote mode to trail remote mode. Once in the lead remote mode, the airbrake system of the second locomotive 116 is able to control airbrake pressure, with the airbrake system of the first locomotive 114 (now in trail mode) being controlled passively and not inhibiting overall consist operation despite the brake system component failure.

According to one aspect, the system 100 may be utilized for handling airbrake system component failures for locomotive consists having two or more consecutive locomotives, since adjacent locomotives can be controlled to "take over" primary airbrake system operation, in place of a locomotive where an airbrake system component has failed.

Although embodiments of the system 100 are shown herein as involving control of the remote locomotives 114, 116 from a distributed power lead locomotive 110, in other embodiments, each locomotive of a consist is configured, as part of the system 100, to potentially carry out the functionality of the system 100. More specifically, instead of the lead locomotive 110 controlling the remote locomotives 114, 116 in the event of a failure condition of one of the remote locomotives, one or both of the remote locomotives could be configured to automatically switch operational modes in the event of a failure condition. For example, the system 100 could be configured such that if there was a failure condition in a first, lead remote locomotive 114 of a remote locomotive consist 106 (such as an airbrake system component failing), the first locomotive 114 and a second, trail remote locomotive 116 in the consist 106 would automatically exchange communications over the distributed power system for the first locomotive 114 to switch to trail remote mode and the second locomotive 116 to switch to lead remote mode.

In other embodiments, the system 100 is configured for handling component failures other than components of the airbrake system. More specifically, the system 100 may be configured to handle failures of any component accessible (for data collection and/or control purposes) to the distributed power system 126. For example, in the case where the distributed power controller 130 is connected to the locomotive control unit 132 directly via a serial or similar communication link, it may be possible to control a second locomotive, through the distributed power system, to perform a function of a failed component connected to the distributed power controller 130 or the locomotive control unit 132 on a first locomotive. Also, in the case of a first locomotive where the distributed power system is connected to a control unit 132 and/or a train line (MU bus) via a modem or similar modulator-type communication unit, and the communication unit subsequently enters a failure condition, the system 100 may be configured to control a second locomotive for the communication unit of the second locomotive to operate in place of the failed unit on the first locomotive, through the distributed power system.

Embodiments of the system 100 allow a distributed power train (e.g., 2×2 locomotives) that has at least two locomotives in any remote consist to have a "hotswap" backup remote airbrake control. The system utilizes a distributed power-equipped trail locomotive more effectively in an emergency scenario. The system is used for situations where a distributed power train experiences a single point failure when a remote electronic airbrake fails. A failed airbrake on a remote locomotive inhibits brake pipe recovery and can only be mitigated in a trail setup state. The system allows an engineer to "hotswap" a backup remote with a functional electronic airbrake, isolate the failed airbrake, and move the train to a safe area for inspection. This minimizes train delay due to possible requirement of crew to walk to the failed distributed power remote locomotive. It also reduces distributed power train splitting incidents and calls for backup helper locomotives. In an embodiment, with a remote consist having two distributed power-equipped locomotives, the trail locomotive's brake valve, being inactive, is placed in backup mode by the system, through the distributed power system. The controlling remote remains to have its airbrake in lead control. The trail airbrake is "business as usual" following A&R (20 pipe) and actuating (13 pipe) pneumatic signals. The crew sets up the train and links the normal and backup remote as part of setup. During the brake pipe test, the system will command the backup remote airbrake to lead in order to ensure brake valve integrity and sensitivity. Following the brake pipe test, the backup remote brake valve will be commanded back to trail. The distributed power operations screen will be configured to black out the backup remote airbrake data as an indication for "hotswap." Alternatively, the screen can be configured to show "Backup" under the distributed power mode.

An embodiment of the present invention relates to a method of controlling a vehicle system. The method includes the steps of receiving information of a failure condition in a first rail vehicle of a rail vehicle consist, and, in response to the failure condition, controlling a second rail vehicle of the rail vehicle consist from a first operational mode to a different, second operational mode, wherein in the second operational mode, the second rail vehicle performs a function that the first rail vehicle cannot due to the failure condition and wherein at least one of the information is received or the second rail vehicle is controlled over a distributed power system of the rail vehicle consist. The method may also include the step of, in response to the failure condition, controlling the first rail vehicle from a third operational mode to a different, fourth operational mode, wherein the first and second operational modes comprise a trail remote mode and a lead remote mode of the second rail vehicle, respectively, and wherein the third and fourth operational modes comprise a lead remote mode and a trail remote mode of the first rail vehicle, respectively. The first rail vehicle may be a first remote locomotive, the second rail vehicle may be a second remote locomotive, and the information may be received at a designated lead locomotive over a communication channel of the distributed power system. The first remote locomotive may be spaced apart from the lead locomotive by at least one non-powered rail car and the second remote locomotive may be adjacent to the first remote locomotive. The function performed by the second rail vehicle may include controlling airbrake pressure. In an embodiment, the method may further include the step of controlling the rail vehicle consist in dependence upon at least one of the type of failure condition, the location of the consist, or weather. Moreover, in an embodiment, the method may also include the steps of isolating a component of the first rail vehicle that caused the failure condition and controlling the consist to move to a safe location for inspection.

In another embodiment a method of controlling a vehicle system includes the steps of, at a third rail vehicle of a rail vehicle consist, receiving information of a failure condition in a first rail vehicle of the rail vehicle consist, wherein the information is received over a communication channel of a distributed power system of the rail vehicle consist, and, in response to the failure condition, controlling a second rail vehicle of the rail vehicle consist from a first operational mode to a different, second operational mode, wherein in the second operational mode, the second rail vehicle performs a function that the first rail vehicle cannot due to the failure condition. The second rail vehicle may be controlled over the distributed power system. The method may also include the step of, at the third rail vehicle, determining whether the failure condition is of a type that can be handled by the second rail vehicle. The third rail vehicle may be a designated distributed power lead rail vehicle. In an embodiment, in response to the failure condition in the first rail vehicle, the method may also include the step of controlling the first rail vehicle from a third operational mode to a fourth operational mode. The first operational mode may be a trail remote mode and the second operational mode may be a lead remote mode. Moreover, the third operational mode may be a lead remote mode and the fourth operational mode may be a trail remote mode. In an embodiment, the rail vehicle consist may further be controlled in dependence upon at least one of the type of failure condition, the location of the consist, or weather. In an embodiment, the function performed by the second rail vehicle in place of the first rail vehicle may include controlling airbrake pressure of an airbrake system.

According to another embodiment, a system includes a control module configured for deployment on a rail vehicle of a rail vehicle consist, the control module being configured to receive information about a failure condition of a component of a system deployed on the rail vehicle or other rail vehicles of the consist and to generate control signals for controlling the rail vehicle or the other rail vehicles in response to the failure condition. The control module may further be configured for interfacing with a distributed power system of the rail vehicle consist. In an embodiment, the control module is deployed on a third rail vehicle of the rail vehicle consist, the failure condition is of a component of a system deployed on a first rail vehicle, and controlling the rail vehicle or other rail vehicles in response to the failure condition includes controlling a second rail vehicle from a first operational mode to a different, second operational mode. In the second operational mode, the second rail vehicle performs a function that the first rail vehicle cannot due to the failure condition. The control unit may also be configured to isolate a component of the rail vehicle that caused the failure condition and to control the consist to move to a safe location for inspection. Moreover, the control unit may be configured to determine whether the failure condition is of a type that can be handled by another rail vehicle of the consist.

Another embodiment relates to a system comprising a control module configured for deployment on a rail vehicle consist. The control module is configured to receive information about a failure condition in a first rail vehicle of the rail vehicle consist. The control module is further configured, responsive to the information, to generate signals for controlling a second rail vehicle of the rail vehicle consist to perform a function that the first rail vehicle cannot due to the failure condition. The control module is configured to at least one of receive the information or transmit the signals over a distributed power system of the rail vehicle consist.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the disclosed subject matter, they are by no means limiting and are exemplary embodiments. Many other embodiments will be apparent to those of ordinary skill in the art upon reviewing the above description. The scope of the inventive subject matter should, therefore, be determined with reference to the appended clauses, along with the full scope of equivalents to which such clauses are entitled. In the appended clauses, the terms "including" and "in which" are used as the plain-English equivalents of the respective terms "comprising" and "wherein." Moreover, in the following clauses, the terms "first," "second," and "third," etc. are used merely as labels, and are not intended to impose numerical requirements on their objects.

This written description uses examples to disclose several embodiments of the invention, including the best mode, and also to enable any person of ordinary skill in the art to practice the embodiments of invention, including making and using any devices or systems and performing any incorporated methods. The patentable scope of the invention is defined by the clauses, and may include other examples that occur to those ordinarily skilled in the art. Such other examples are intended to be within the scope of the clauses if they have structural elements that do not differ from the literal language of the clauses, or if they include equivalent structural elements with insubstantial differences from the literal languages of the clauses.

The foregoing description of certain embodiments of the present invention will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method for controlling a vehicle, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A method of controlling a vehicle system, comprising: the steps of: receiving information of a failure condition of a first component in a first rail vehicle of a rail vehicle consist, the first component being configured to performs a function; and in response to the failure condition of the first component, controlling a second rail vehicle of the rail vehicle consist from a first operational mode to a different, second operational mode, wherein in the second operational mode, the second rail vehicle performs the function of the first component of the first rail vehicle that the first component cannot due to the failure condition; in response to the failure condition, controlling the first rail vehicle from a third operational mode to a different, fourth operational mode; and wherein the first and second operational modes comprise a trail remote mode and a lead remote mode of the second rail vehicle, respectively; wherein the third and fourth operational modes comprise a lead remote mode and a trail remote mode of the first rail vehicle, respectively; and wherein at least one of the information is received or the second rail vehicle is controlled over a distributed power system of the rail vehicle consists.

2. The method according to claim 1, wherein: the first rail vehicle is a first remote locomotive; the second rail vehicle is a second remote locomotive; and the information is received at a designated locomotive over a communication channel of the distributed power system.

3. The method according to claim 2, wherein: the first remote locomotive is spaced apart from the lead locomotive by at least one-powered rail car.

4. The method according to claim 3, wherein: the second remote locomotive is adjacent to the first remote locomotive.

5. The method according to claim 1, wherein: the function is controlling airbrake pressure.

6. The method according to claim 1, further comprising the step of: controlling the rail vehicle consists in dependence upon at least one of the type of failure condition, the location of the consist, or weather.

7. The method according to claim 1, further comprising the steps of: isolating the first component of the first rail vehicle that caused the failure condition; and controlling the consist to move to a false location for inspection.

8. A method of controlling a vehicle system, comprising the steps of: at a third rail vehicle of a rail vehicle consist, receiving information of a failure condition in a first rail vehicle of the rail vehicle consist, the failure condition causing the first rail vehicle to be unable to control airbrake pressure of an airbrake system of the rail vehicle consist, wherein the information is received over a communication channel of a distributed power system of the rail vehicle consist; and in response to the failure condition, controlling a second rail vehicle of the rail vehicle consist from a first operational mode to a different, second operational mode, wherein in the second operational mode, the second rail vehicle controls the airbrake pressure that the first rail vehicle cannot due to the failure condition, wherein the second rail vehicle is controlled over the distributed power system; wherein the first operational mode is a trail remote mode; and wherein the second operational mode is a lead remote mode.

9. The method according to claim 8, further comprising the step of: at the third rail vehicle, determining whether the failure condition is of a type that can be handled by the second rail vehicle.

10. The method according to claim 8, wherein: the third rail vehicle is a designated distributed power lead rail vehicle.

11. The method according to claim 8, further comprising the step of: in response to the failure condition in the first rail vehicle, controlling the first rail vehicle from a third operational mode to a fourth operational mode.

12. The method according to claim 11, wherein: the third operational mode is a lead remote mode; and the fourth operational mode is a trail remote mode.

13. The method according to claim 8, further comprising the step of: controlling the rail vehicle consist in dependence upon at least one of the type of failure condition, the location of the consist, or weather.

14. A system comprising: a control module deployed on a third rail vehicle of a rail vehicle consist, the control module being configured to receive information about a failure condition of a component of a system deployed on a first rail vehicle of the consist and to generate control signals for controlling a second rail vehicle of the consist from a first operational mode to a second, different operational mode in response to the failure condition, wherein in the second operational mode, the second rail vehicle performs a function that the first rail vehicle cannot due to the failure condition; wherein the first operational mode is a trail remote mode; wherein the second operational mode is a lead remote mode; wherein the control unit is further configured to isolate a component of the rail vehicle that caused the failure condition and to control the consist to move to a safe location for inspection; and wherein the control module is further configured for interfacing with a distributed power system of the rail vehicle consist.

15. The control system of claim 14, wherein: the control unit is configured to determine whether the failure condition is of a type that can be handle by another rail vehicle of the consist.

16. The control system of claim 14, wherein the control module is further configured to at least one of receive the information or transmit the control signals over the distributed power system of the rail vehicle consist.

* * * * *